United States Patent [19]

Hongo

[11] Patent Number: 4,930,332

[45] Date of Patent: Jun. 5, 1990

[54] APPARATUS FOR EXCHANGING TOOL FOR BENDING MACHINE

[75] Inventor: Toshio Hongo, Ichikawa, Japan

[73] Assignee: Maru Kikai Kogyo Co., Ltd., Japan

[21] Appl. No.: 406,835

[22] Filed: Sep. 13, 1989

Related U.S. Application Data

[63] Continuation of Ser. No. 67,448, Jun. 26, 1987, abandoned.

[30] Foreign Application Priority Data

Jun. 30, 1986 [JP] Japan ..... 61-151403

[51] Int. Cl.[5] ..... B21J 13/02

[52] U.S. Cl. ..... 72/446; 72/389; 72/323; 72/413; 72/478; 72/482; 72/319

[58] Field of Search ..... 72/389, 319, 323, 481, 72/446, 478, 320, 321, 413, 322, 482, 440; 269/164

[56] References Cited

U.S. PATENT DOCUMENTS

| | | | |
|---|---|---|---|
| 2,302,958 | 11/1942 | Jensen | 72/319 |
| 3,147,791 | 9/1964 | Raven et al. | 72/319 |
| 3,359,771 | 12/1967 | Meyerchick, Jr. | 72/319 |
| 3,495,435 | 2/1970 | Hanni | 72/448 |
| 4,089,198 | 5/1978 | Amano et al. | 72/320 |
| 4,112,731 | 9/1978 | Anderson et al. | 72/320 |
| 4,532,792 | 8/1985 | Hongo | 72/319 |
| 4,660,402 | 4/1987 | Hongo | 72/319 |

FOREIGN PATENT DOCUMENTS

| | | | |
|---|---|---|---|
| 148021 | 9/1983 | Japan | 72/319 |
| 187216 | 11/1983 | Japan | 72/319 |

*Primary Examiner*—David Jones

*Attorney, Agent, or Firm*—Andrus, Sceales, Starke & Sawall

[57] ABSTRACT

A bending machine having a plurality of reversible dies mounted on the lower end of a ram. A reversibly supporting shaft is laterally installed at the rear side of the ram, and a reversing lever is mounted on the reversibly supporting shaft. The reversible dies are removably mounted on the ends of the reversing lever to be readily exchanged from the upper die to the goose-neck die or vice versa.

11 Claims, 13 Drawing Sheets

APPARATUS FOR EXCHANGING TOOL FOR BENDING MACHINE

This is a continuation of application Ser. No. 07/067,448, filed June 26, 1987, now abandoned.

BACKGROUND OF THE INVENTION

1. Field of the Invention

This invention relates to an apparatus for exchanging a tool of a bending machine and, more particularly, to an apparatus for readily exchanging a thin reverse die disposed at the center of a split die row in a bending machine for automatically altering an upper die length.

2. Description of the Prior Art

As fields employing panels formed by bending the four sides of work sheet are recently increased, a bending machine of the type having a split upper die capable of altering in its upper die length responsive to the length of the work has been used different from a bending machine or the type for exchanging the upper die by avoiding the interference with a U-shaped rise of the side edge of the work (e.g., the edge of the short side) previously bent at its edges so as to bend the other side edge of the work (e.g., the edge of the long side). When a number of split upper dies (hereinafter referred to as "split dies") of the same length are closely contacted to form a series of upper dies in the split die type bending machine, the bending machine cannot be adapted for altering the work length since the work length altering step takes a pitch of one split die. To this end a bending machine having several types of split dies of different lengths is prepared to cope with the different work lengths in combination with the split die group has been known.

Since the above-described bending machines all have inserted the split dies to the grooves on the lower end of a ram by a manual work when altering the die length to clamp the dies thereto, it takes a long time to change the die length. Then, another bending machine in which split dies hung from the grooves of the lower end of a ram are moved by a proper NC control system, a plurality of reversible thin split dies (hereinafter referred to as "reversible lower dies") are attached to the central portion of the split die group of standard length and the reversible dies of the necessary number are risen or reversed by the NC to automatically alter the die length and retract the dies to thereby working various shapes in one machine has been proposed.

A bending machine or a press brake exchanges a die whenever altering the bending angle and/or the bending shape of a work sheet. In this case, the die is exchanged not only from an upper die of certain angle to another upper die of different angle but also from the upper die to a goose-neck die, or vice versa. As above mentioned, since a reversing mechanism in the press brake having reversible dies is associated at a position approaching from a back gauge on the rear wall of a ram to other unit, it is easy to exchange the dies of a standard split die group from each other or the die to the goose-neck die, but it is very difficult to exchange the reversible dies. Therefore, in the actual working, the working necessary to exchange the dies should be executed by other press brake or a folding machine by avoiding the die exchange. Thus, there arise drawbacks that one bending machine or press brake should originally operate various workings but other machines should be employed on separate working lines.

An object of the present invention is to provide an apparatus for readily exchanging reversible dies of a bending machine having upper die length altering function.

Another object of the present invention is to provide an apparatus for accurating controlling the number of reversible dies.

SUMMARY OF THE INVENTION

The present invention provides an apparatus for exchanging a die of a bending machine or a press brake having a plurality of reversible dies attached to the lower end of a ram which comprises a reversing lever mounted on a reversing shaft laterally installed at the rear side of the ram and reversible dies removably supported to the end of the reversing lever.

More particularly, the present invention has the following constitution. That is, the present invention provides an apparatus for exchanging reversible dies in a bending machine or a press brake having a series of upper dies having a plurality of reversible dies reversibly mounted in the center on the lower end of a ram and a number of split dies disposed slidably left and right of the reversible dies, reversed and retreated in an arbitrary number of the reversible dies backward of the ram, and/or separated in unnecessary split dies from a series of the upper die row to thereby provide alterable length upper dies comprising a reversibly supporting shaft laterally installed at the rear of the ram; left and right brackets provided at the rear side of the split die adjacent to one of a thin die group; a first spline cylinder inserted into the reversibly supporting shaft and anti-rotated to one bracket; a cylindrical portion extended from the first spline cylinder to the other bracket side; a second spline cylinder rotatably inserted into the cylindrical portion; a reversing lever mounted over the first and second spline cylinders between the left and right brackets to be inserted at the end of the lever into a hole formed at the thin die; reverse driving means for reversing the reversing lever 180° in engagement with the second spline cylinder; and number-of-reversing dies selecting means for determining a predetermined number of reversible dies engaged with the second spline cylinder by moving the boundary of both the spline cylinders.

The split dies have, for example, 10 to 15 left and right dies having 100 mm length, totally 20 to 30 dies having 100 mm length, and a central thin die having 5 mm length, a central thin die having 10 mm length and 4 central dies having 20 mm length. The length of the die having 100 mm pitch is adjusted by the removable or slidable split die, and the length of the die having 5 mm pitch is adjusted by a plurality of dies.

When the reversing lever disposed steadily at the reversing position at the rear side of the split dies is turned clockwisely approx. 180°, the reversible die engaged with the reversing lever is rotated toward the lower end of the ram, inserted at its upper portion to the groove of the lower end of the ram, and the reversible dies are simultaneously associated with the left and right split dies in series to become upper dies of a predetermined length. The reversible dies not associated in the upper die length is held at the reversing position. The reversible dies at the reversing position remains steadily in a reversed attitude as engaged with the end of the lever. The split dies are exchanged by inserting or retreating the dies into or from the grooves of the lower end of the ram. The reversible dies are stopped in the midway from the normal position toward reversing, extracted in this attitude from the end of the lever, and then exchanged by the reversible die of another type. The length of the dies by the reversible dies is adjusted by operating locking means, number-of-reversions selecting means and reversibly driving means.

BRIEF DESCRIPTION OF THE DRAWINGS

A preferred embodiment of the invention-illustrative of the best mode in which applicants have contemplated applying the principles-is set forth in the following description and shown in the drawings and is particularly and distinctly pointed out and set forth in the appended claims.

DESCRIPTION OF THE PREFERRED EMBODIMENTS

Figure 1:
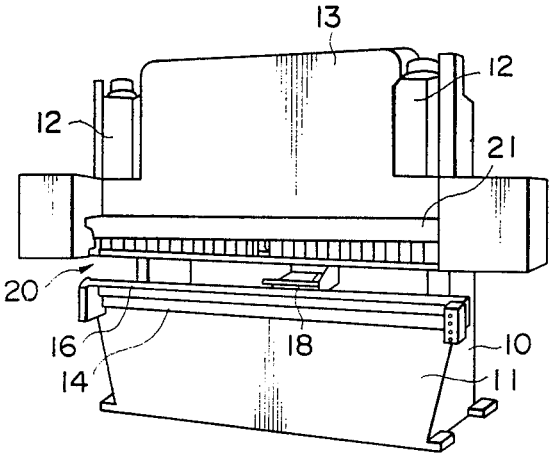
FIG. 1 is a perspective view showing a bending machine or press brake provided with an apparatus for exchanging a tool according to the present invention.

Referring now to the drawings, a preferred embodiment of the invention is illustrated therein and numeral reference 10 indicates left and right frames, 11 is a front plated stretched in front of the frames, 12 bending hydraulic main cylinders mounted on the upper ends of the frames, 13 a ram driven upward and downward by the actuation of the main cylinders 12, 14 a bed, 15 a slide provided on the bed 14, 16 a lower die or a die, 17 V-shaped groove formed in the lower die 16, 18 a back gauge, 19 a cushion cylinder provided in the ram, 20 a group of upper dies or punches, 21 a beam provided on the lower end of the ram, and 25 a groove formed on the lower surface of the beam 21.

Figure 4:
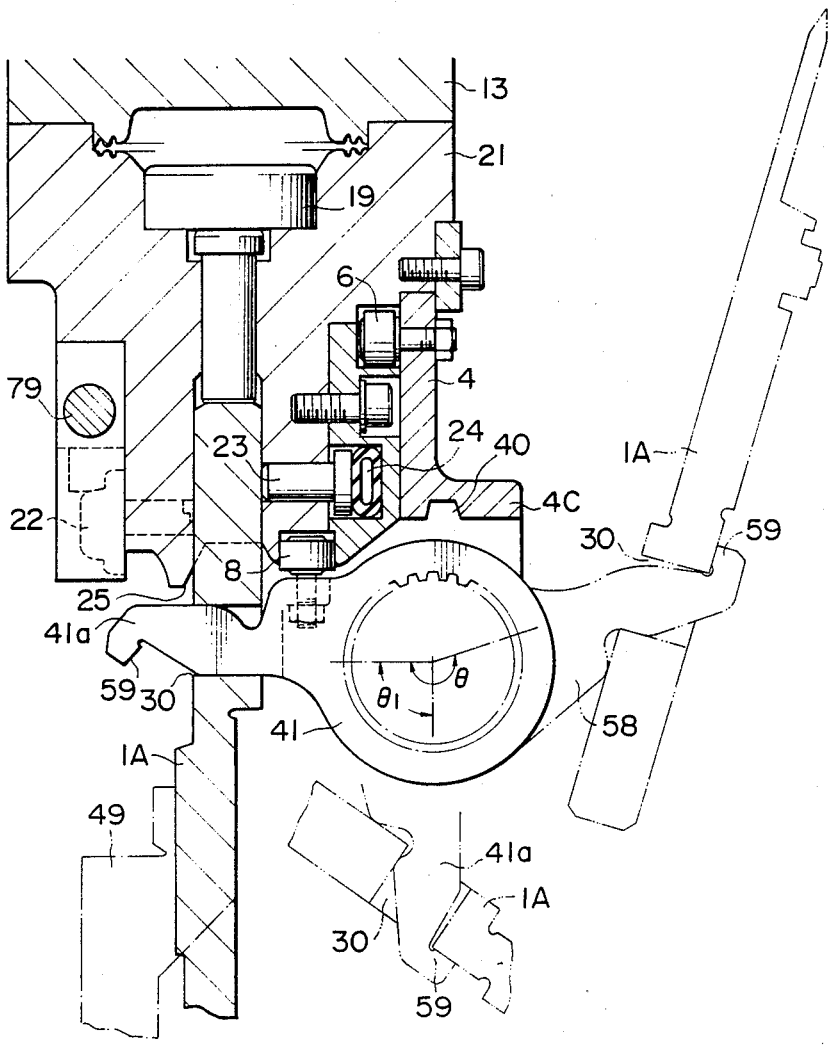
FIG. 4 is an enlarged sectional view showing the same in FIG. 3.
Figure 12:
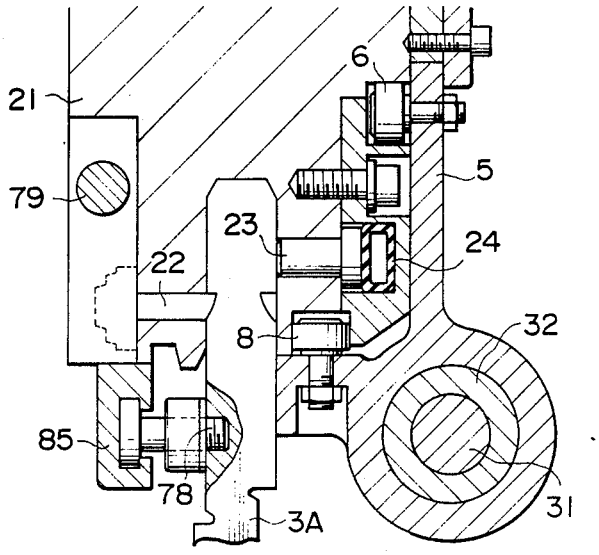
FIG. 12 is a sectional view taken along the line XII—XII in FIG. 5.

The group of upper dies 20 are constituted from a number of split dies 2A, 2B, 2C . . . , 3A, 3B, 3C . . . , and six thin reversible dies 1A, 1B . . . , 1F reversibly disposed between the split dies 2A and 3A. These split dies and the reversible dies are removably mounted at the upper portions thereof in the groove 25 of the beam 21. The split dies 2A, 2B . . . , and 3A, 3B . . . , are inserted into the groove 25, and then clamped by clamping means with bolts 22 on the front face, and pins 23 and extended tubes 24 (FIGS. 12 and 13) on the back face. Since the reversible dies 1A, 1B . . . , 1F are held at the positions of the forward rotating ends of the reversing levers 41 to 46 to be described in detail later, the bolt clamping from the front face is omitted, and the dies are clamped by the pins 23 and the extended tubes 24 on the back face (FIG. 4).

Figure 2:
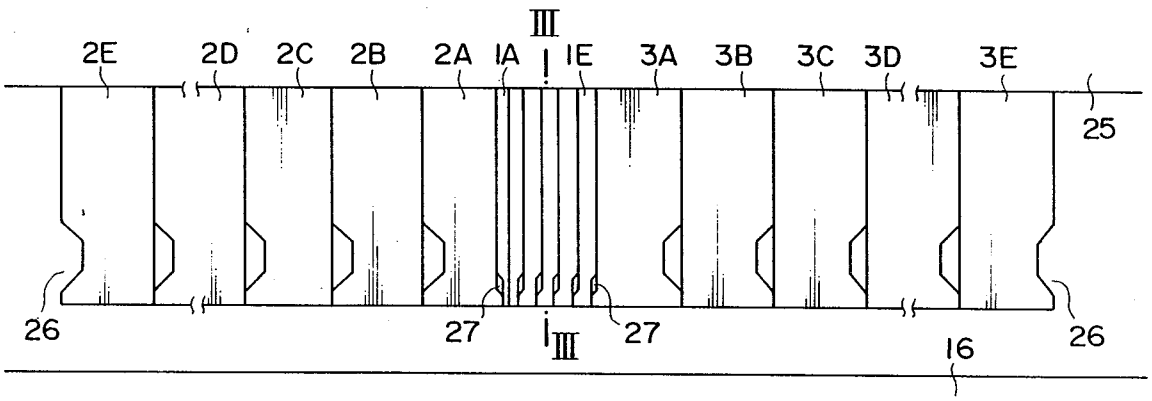
FIG. 2 is an enlarged front view showing the upper die row in FIG. 1.
Figure 9:
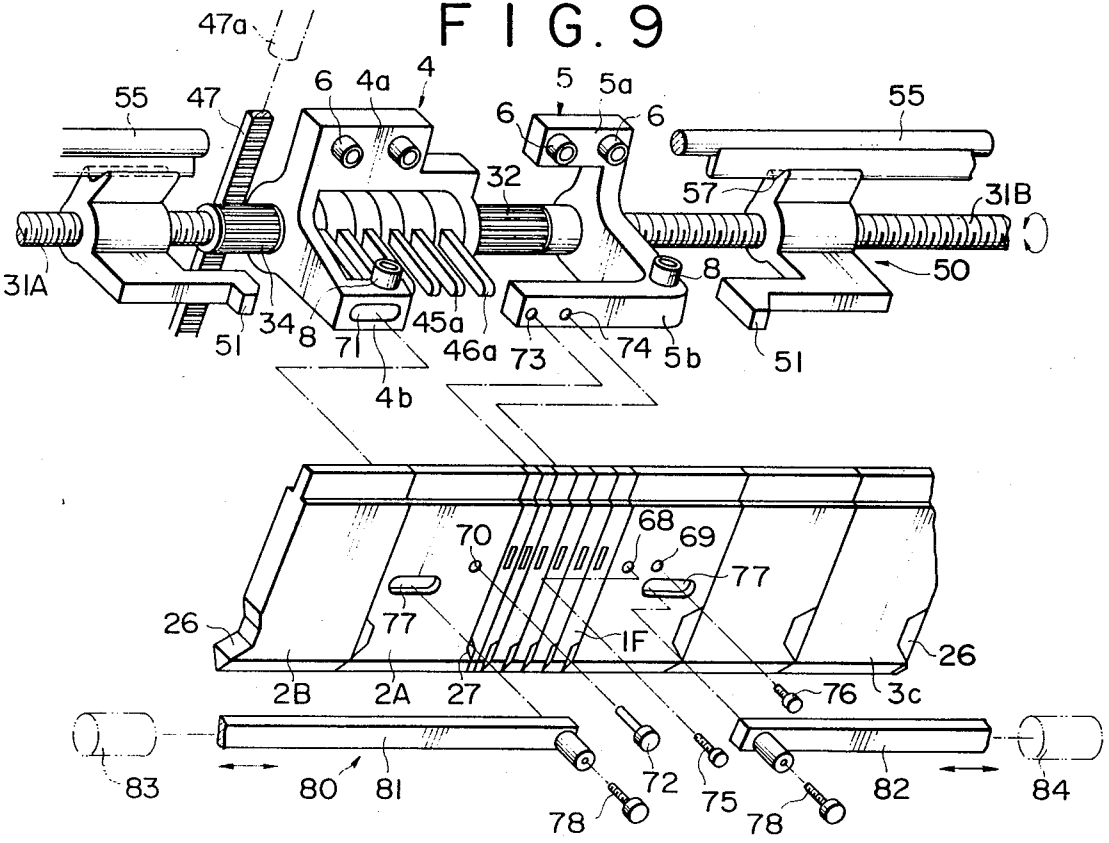
FIG. 9 is an exploded view of the reversibly driving means the upper die row.

Pawl driving means 50 for sliding the split dies in the die longitudinal direction is provided at the rear sides of the split dies 2B . . . , and 3A, 3B . . . , to be described later with reference to FIG. 9. The number of reversing the thin reversible dies is then selected, and the die length can be thereafter finely adjusted by operating reversibly driving means 47. That is, the reversible dies 1A, 1B . . . , 1F are supported by the reversing levers 41 to 46 provided at the rear sides of the split dies 2A and 3B to be described in detail with reference to FIG. 4 and the following drawings, the rotating ends when the upper die row are rotated backward (i.e., at reversing time) are stopped in the reversed attitude behind the central left and right split dies 2A, 3A (FIG. 5), and inserted into between the split dies 2A and 3A by the rotation approx. 180° to form a series of upper dies together with the left and right split dies (FIGS. 2 and 9). The boss portions of the reversing levers are supported to the spline cylinders bridged over between opposed ring retaining portions formed at the brackets 4 of the rear side of the split die 2A.

The split dies 2A, 2B . . . , and 3A, 3B . . . , have ordinary die length 100 mm, and totally 2 to 3 mm in the entire split dies of 10 to 15 left and right dies. The die length can be adjusted at 100 mm pitch by altering the number of split dies to be used. Each split die is formed with a release 26 for avoiding the interference with the U-shaped rise of the work at the outside end thereof. Bent portions 27 are formed at the inside ends of the split dies 2A, 2B to closely contact the reversible dies.

The first reversible die 1A has 20 mm of a root and 5 mm of an end, and the second reversible die 1B has 20 mm of a root and 10 mm of an end. The other reversible dies 1C to 1F each has 20 mm of a root and an end. The reversible dies can be finely adjusted in the upper die length from 5 mm to 95 mm at 5 mm pitch by reversing a predetermined number by actuating number-of-reversing dies selecting means 80 and locking means 60 (FIG. 10) to be described later.

Figure 14:
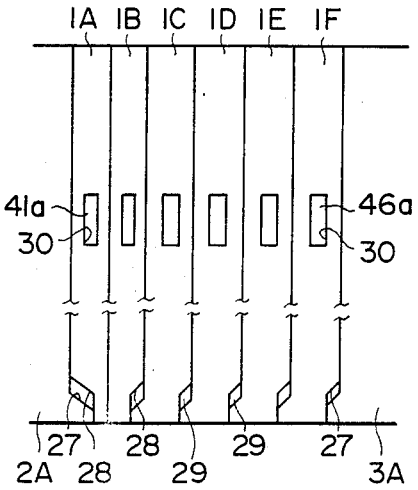
FIG. 14 is a front view showing reversible die group.
Figure 15:
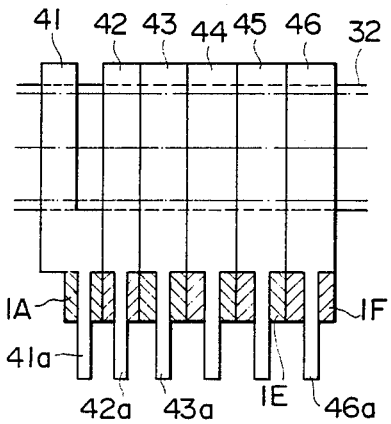
FIG. 15 is a plan view showing reversing lever group.

The first and second reversible dies 1A, 1B have slant faces 28 near the ends to narrow the effective lengths to 5 mm and 10 mm, respectively, and the third to sixth reversible dies 1C to 1F have bends 29 in the proximity of the lower portions as seen from the front face in such a manner that the end is bent leftward as seen from the front side (FIG. 14). The proximity of the upper portion of each reversible die is formed with a hole 30 for detachably inserting the ends 41*a* to 46*a* of the reversing levers 41 to 46. The end of the reversing lever has a shoulder 58 contacting the proximity of the upper portion of the rear side of the hole 30 of the reversible die and a hook 59 to be engaged with the lower portion of the front side of the hole 30 (FIG. 4).

The apparatus according to the present invention has such features having a plurality of (6 in the drawings)

reversible dies provided at the lower end of a ram, and a number of left and right split dies in a die length altering device comprising reversing levers 41 to 46 provided at a reversibly supporting shaft 31 at the rear side of the ram for removably supporting the reversible dies. The respective constituents will be described in detail in the present invention.

REVERSING LEVER

Figure 5:
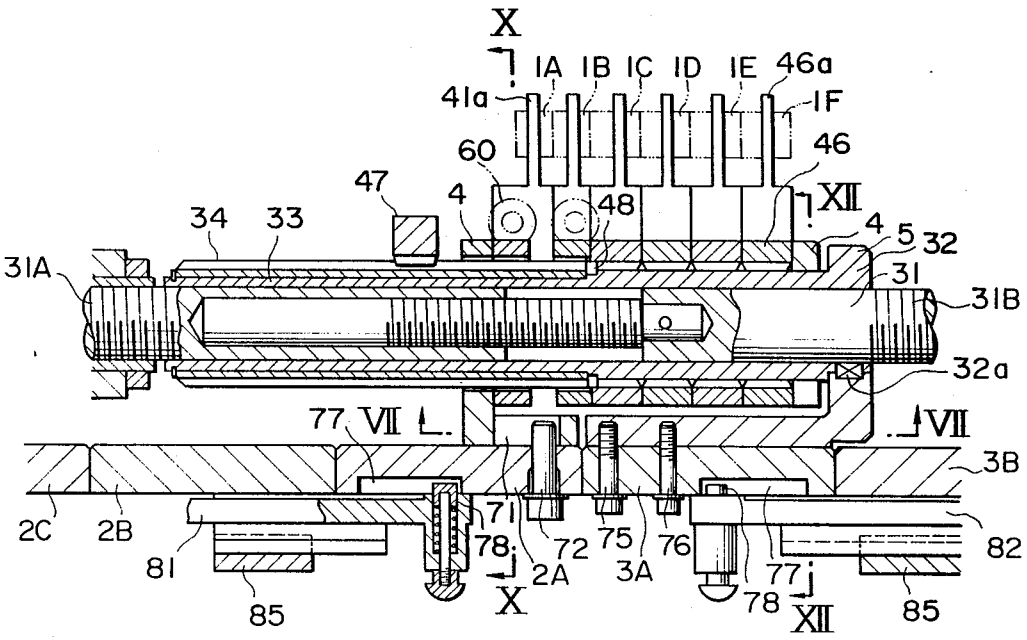
FIG. 5 is a cross-sectional plan view of reversibly driving means.

A reversibly supporting shaft 31 laterally installed at the rear sides of a number of split dies 2A, 2B . . . , and 3A, 3B . . . , having standard die length couples screw rods 31A and 31B having clockwise and counterclockwise threads on the extensions of the axial center line thereof (FIG. 5). The reversibly supporting shaft 31 is supported to brackets 4 and 5 slidably supported to the rear portion of the beam 21 at the lower end of the ram to be axially movable 50 mm at the maximum leftward and rightward in FIG. 5. A first spline cylinder 32 is inserted on the shaft 31, and a second spline cylinder 34 is rotatably engaged with a cylindrical portion 33 of the left half of the first spline cylinder 32. The first spline cylinder 32 is secured fixedly to the right side bracket 5, and the second spline cylinder 34 is rotatably inserted into the left side bracket 4. The reversibly supporting shaft 31 supports the first spline cylinder 32 having the cylindrical portion 33, and from both ends of the supporting shaft 31 are integrally extended screw rods **31*a* and 31*b*** having clockwise and counterclockwise threads for driving a pawl to be described later. That is, the reversing shaft core and the split die slidably driving shaft core are associated on a common shaft.

Figure 10:
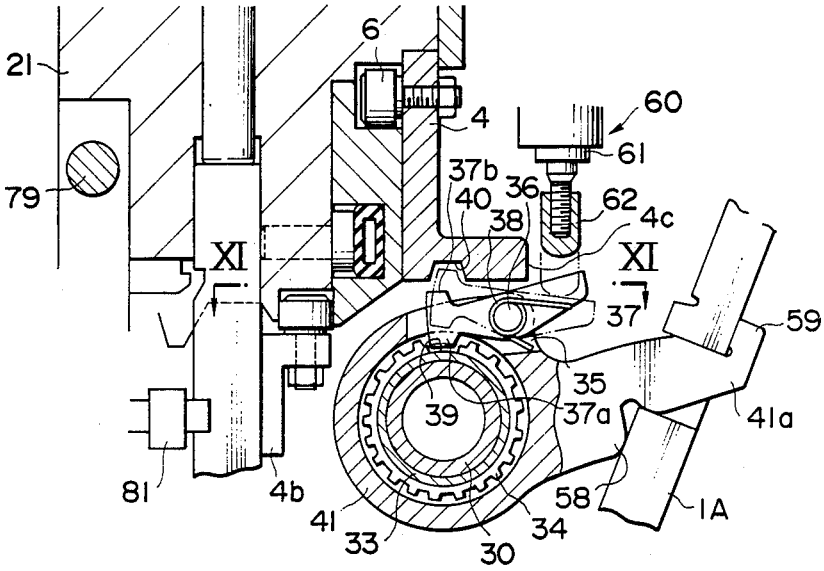
FIG. 10 is a sectional view taken along the line X—X in FIG. 5.
Figure 11:
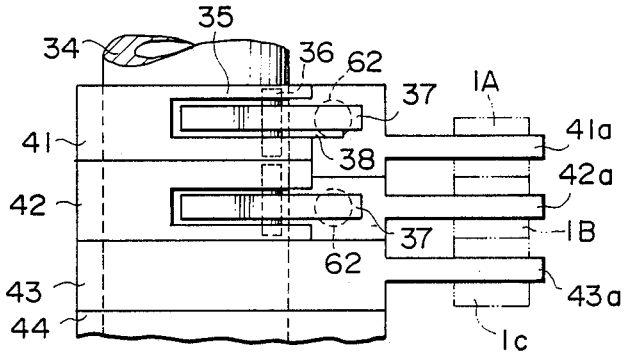
FIG. 11 is a plan view taken along the line XI—XI in FIG. 10.
Figure 16:
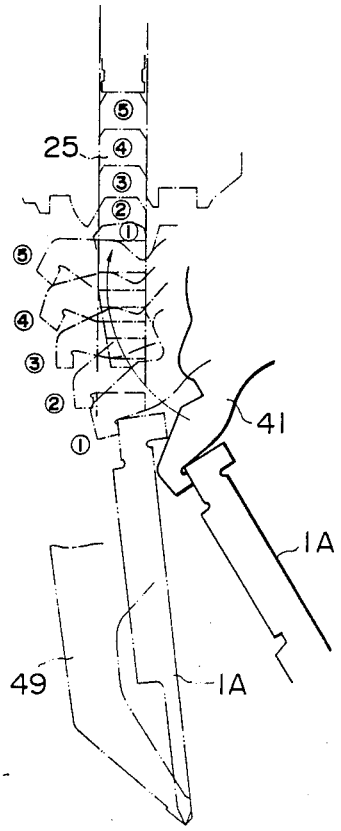
FIG. 16 is a view showing the reversing lever and the reversible die reversing trace.

Six reversing levers 41 to 46 are mounted over between two spline cylinders 32, 34 abutting each other. The ends of the respective reversing levers are engaged within the holes 30 of the thin dies 1A, 1B . . . , 1F as described above. The first and second reversing levers 41, 42 are loosely engaged with both the first and second spline cylinders 32, 34, and the third to the sixth reversing levers 43 to 46 are engaged at their annular boss portions with the splines of the spline cylinders 32, 34. The reversing levers 41, 42 loosely engaged with the spline cylinders 32, 34 are formed at parts of the annular boss portions with brackets 35 as shown in FIGS. 10 and 11, and arms 37 are supported through pins 36 to the brackets 35. The arms 37 are always urged at the lower **37*a* by torsion springs 38 to protrude into the recess 39 of the spring cylinder 34. Recesses 40 are formed on the lower sides 4*c* of the brackets 4 oppositely to the upper ends 37*b* of the arms. Locking means 60 by a cylinder 61 and a pressing member 62 for pressing the arms 37 to insert the upper ends 37*b* of the arms to the recesses 40 to lock the upper ends 37*b* of the arms 37 is provided at the rear wall of the beam 21. When the cylinder 61 and the pressing member 62 are operated to engage the upper ends 37*b* of the arms 37 within the recesses 40, the reversing levers 41, 42 are locked to the brackets 4 side, that is, the beam 21 side. Thus, even if the spline cylinder 34 is rotated, it is not reversed. The third to the sixth reversing levers 43 to 46 do not have the said locking means. FIG. 16** is a view showing the trace of the reversing operation.

NUMBER-OF-REVERSING DIE SELECTING MEANS

Figure 8:
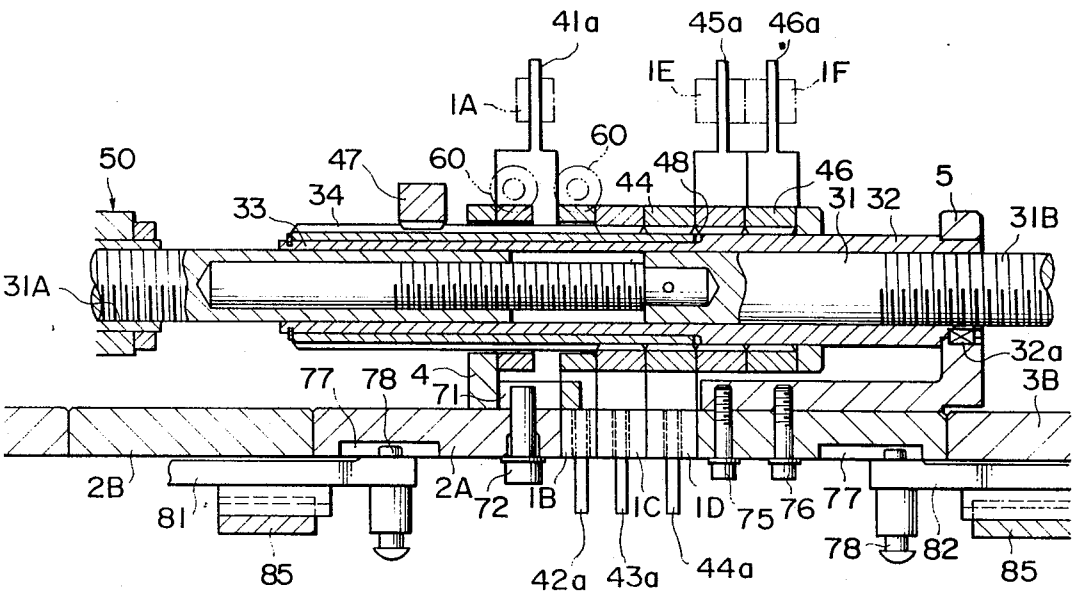
FIG. 8 is a cross-sectional plan view showing the condition that two reversible dies are inserted into between slidably split dies in FIG. 5.

The number-of-reversing dies selecting means 80 is constituted, as shown in FIG. 9, from rods 81, 82, cylinders 83, 84 and brackets 4, 5. As above mentioned, the left bracket 4 rotatably supports the second spline cylinder 34, and a pin **32*a* is mounted on the right bracket 5 to support the first spring cylinder 32 in an anti-rotating state (FIGS. 5 and 8). These brackets 4, 5 are movably attached to the beam 21. That is, vertical rollers 6, 6 are provided at the upper sides 4*a*, 5*a* of the brackets 4, 5 to be engaged within a groove 7 formed on the back face of the beam 21, and horizontal rollers 8, 8 are provided on the front end faces 4*b*, 5*b* of the brackets 4, 5 to be engaged within a groove 9 formed on the lower face of the beam 21 to enable the brackets 4, 5 to be moved leftward and rightward (FIGS. 4, 9 and 10). The left bracket 4 is formed at its front end 4*b* with a horizontal long hole 71, to which the end of a pin 72 passed from a hole 70 opened in the central left side split die 2A is inserted to prove the horizontal relative movements of the split die 2A and the bracket 4 at the number-of-reversing die selecting time by the movements of die opening rods 81, 82. On the other hand, the right side bracket 5 is formed at its front end face 5*b* with two threaded holes 73, 74, within which bolts 75, 76 passed through holes 68, 69 opened in the central right side split die 3A are engaged to be clamped at the split die 3A (FIG. 5). Recess grooves 77 having 30 mm length are formed on the front faces of the split dies 2A, 3A, and pins 78 provided at the ends of the rods 81, 82 are inserted into the grooves 77 of the split dies 2A, 3A (FIG. 9). The rods 81, 82 are supported to a guide 85 suspended from a rod 79 provided at the front portion of the beam 21 (FIGS. 4, 5**).

The reversing levers 41 to 46 are inserted into any of the spline cylinders 32, 34, and the number of reversing dies can be selected by sliding a boundary 48 where both the spline cylinders 32, 34 abut each other. The number of the reversing dies can be selected by moving the rods 81, 82 rightward or leftward by actuators 83, 84 as shown in FIG. 9, that is, by moving the split dies 2A, 3A to engage the reversing levers of a predetermined number with the left spline cylinder 34. When the left rod 81 is first moved leftward 45 mm in the state in FIG. 5, the pin 78 at the end of the rod 81 moves to the left limit of the long hole 77 at the initial 30 mm movement of the rod 81, and only the split die 2A moves leftward 15 mm by the next stroke of 15 mm of the rod 81. The bracket 4 remains steady during this period, and the boundary 48 does not accordingly move. When the second spline cylinder 34 is rotated 180° without operating the locking means 60 in FIG. 10 in this state, the first and second reversing levers 41, 42 will rotate (to adjust totally 15 mm, refer to the description with reference to FIG. 18 to be described later). Since the locking means 60 are respectively provided at the reversing levers 41, 42, when the locking means of any lever is operated and the second spline cylinder 34 is rotated, the reversing lever 41 or 42 is rotated to adjust 5 mm or 10 mm of the die length. When the left and right rods 81, 82 are then simultaneously driven, that is, the bracket 4 is moved leftward 15 mm by the movement of 45 mm of the left rod 81, the bracket 5 is then moved rightward 20 mm by the movement of 20 mm of the right rod to be totally moved 35 mm to move the boundary 48 20 mm rightward, the first to the third reversing levers 41 to 43 become rotatable to adjust 30 to 35 mm die length. Further, when moving the boundary 48 at every 20 mm, the fourth to the sixth reversing levers 44 to 46 sequentially become rotatable. The reversibly driving means 47 is operated by a rack engaged with the spline cylinder 34 at each stage to reversibly drive only the operating lever engaged with the spline cylinder 34. FIG. 8 is a cross-sectional plan view of the case that the second to the fourth reversing levers are rotated to adjust 50 mm the thin dies 42 to 44 in addition to the upper die row.

DIE EXCHANGING

FIG. 4 shows the condition that the reversing lever is stopped at the forward rotating end and the thin reversible dies supported to the respective levers form a series of upper dies together with the left and right split dies.

When the reversing levers 41 to 46 are rotated counterclockwise at $\theta=180°$ to 200° as shown by a chain line in FIG. 4, the reversible dies are reversed in a reversible standby attitude. When the reversing levers are stopped if the levers are rotated at the intermediate angle $\theta_1=90°$ to 100° and the cutting edge sides of the reversible dies are turned to be floated, and the levers can be removed from their ends. After the levers are removed, the die can be exchanged, for example, to the goose-neck die 49. The inserting type split dies 2A, 2B . . . , 3A, 3B . . . , to be inserted into the groove 25 are exchanged by loosening the bolt 22 as above mentioned, contracting the tube 24, then removing the split dies, and the dies are exchanged by loosening the bolts 22 as described above, contracting the tube 24 and then removing it to exchange the die with the goose-neck die 49.

PAWL DRIVING MEANS 50

The pawl driving means 50 is provided to move the split dies in die longitudinal direction so as to determine the upper die length. That is, in case of automatic working, to form a gap between the upper die of the end of the work and the upper die adjacent to the previous upper die, pawls 51 are engaged within recesses 53 formed on the back faces of the split dies to rotate to move the screw rods 31A, 31B extended to both ends of the reversibly supporting shaft 31.

Figure 6:
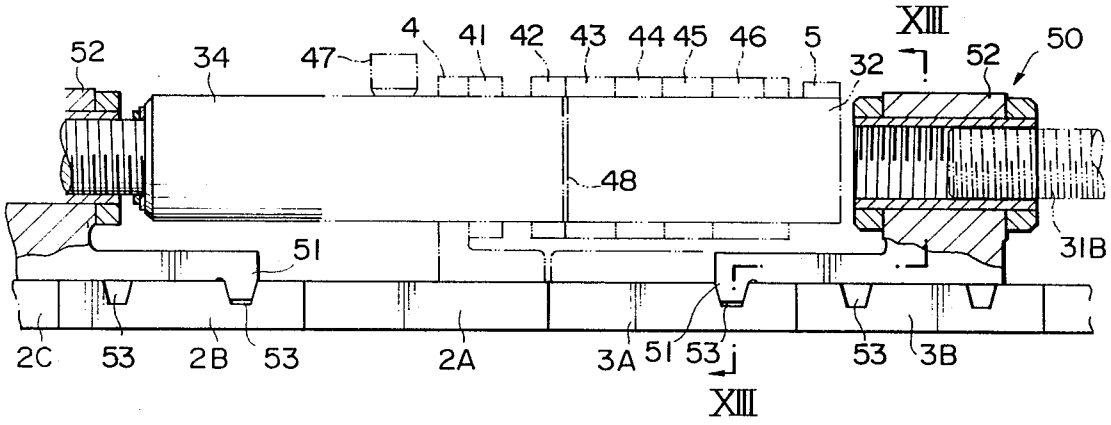
FIG. 6 is a cross-sectional plan view of a selecting pawl.
Figure 7:
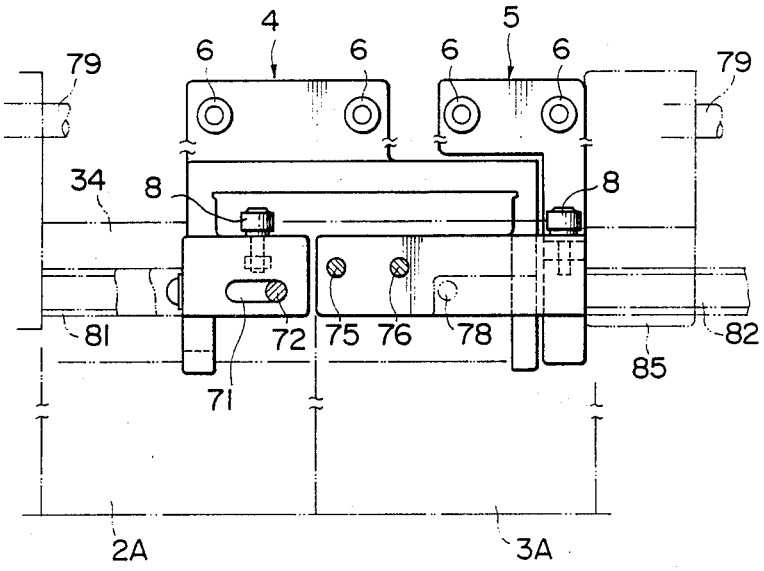
FIG. 7 is a front view taken along the line VII—VII in FIG. 5.
Figure 13:
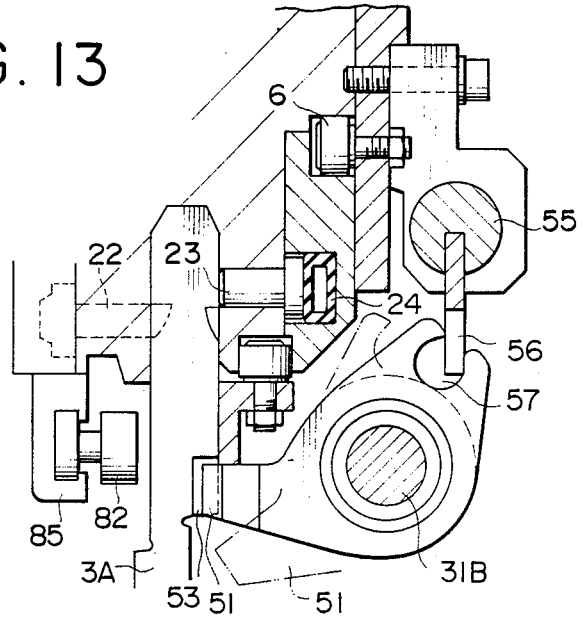
FIG. 13 is a sectional view taken along the line XIII—XIII in FIG. 6.

The detail of the means 50 is shown in FIG. 6. FIG. 6 shows the state that the pawls 51 are engaged within the recesses 53 formed on the back faces of the split dies 2B, 3A. As described above the clockwise and counterclockwise threaded type screw rods 31A, 31B are laterally installed along the upper die row to be rotatable by motors (not shown) at the ends of the rods. The bosses of the left and right pawls 51 are engaged with the screw rods 31A, 31B. When the pawls 51 are disengaged, the pawls move along the die longitudinal direction by rotating the motors. As shown in FIGS. 9 and 13, a rockable shaft 55 is provided at the rear side of the beam 21. The rockable shaft 55 is rotated in a range of a predetermined angle by a cylinder 47*a* (FIG. 9). A protruding piece 56 is formed on the entire length of the rockable shaft 55 in the lower side longitudinal direction, and is engaged within a cutout 57 of the upper piece of the pawl 51. When the cylinder 47*a* is extended from the state in FIG. 13, the rockable shaft 44 is rotated at an angle counterclockwise to thus rotate the end of the pawl to a position as designated by a chain line to thereby disengage the pawls from the recess 53 of the upper die.

When all the split dies are used in the maximum die length as shown in FIG. 1, the recesses 53 of the split dies are so provided as to become a predetermined pitch (e.g., 50 mm pitch when the split die length is 100 mm). When each of all the split dies is formed with a recess 53, the die length of $100\times2=200$ mm pitch can be altered in each die by engaging the pawls 51 with the recesses 53 of symmetrical positions to operate (moving the pawls longitudinally of the screw rods 31A, 31B), but in case of the both end split dies, the left and right movements of the dies 50 mm and hence the selections of the primary die lengths of 100 mm pitch are by forming each recess 53 in each split die, and forming two recesses at 50 mm pitch in the other split dies, and engaging the pawls with the recesses 53 of the positions displaced at one pitch of the left and right upper dies.

FIG. 6 shows the conditions that the left selecting pawl 51 is engaged with the inside recess 53 of the split die 2B and the right pawl 51 is engaged with the recess 53 of the position corresponding to the outside of the split die 3A (however, this die does not have the inside position). The outside or inside upper die row is moved at an equal distance from the split dies by normally or reversely rotating the screw rods 31A, 31B of the left and right threaded screws in this state. However, when the pawl 51 is removed, then moved outside at one pitch, the pawl is again operated to engage the pawl with the recess 53 of the split die, the left pawl is engaged with the outside recess 53 of the same split die 2B, but the right pawl is engaged within the inside recess of the adjacent split die 3B. When both the pawls 51 are, then, moved outside, the split dies 2B, 3A are moved outward to be altered primarily at 100 mm pitch. Thus, the same effect as that one upper die is moved can be provided by engaging both the pawls with the recesses of asymmetrical positions. The upper die row displaces at the centers with respect to the center of the bed when moving the dies 100 mm, but the entire dies are centered by cylinders (83, 84).

OPERATION

Figure 3:
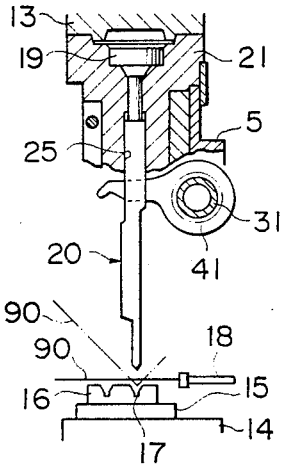
FIG. 3 is a sectional view taken along the line III—III in FIG. 2.

Next will be described the operation of the apparatus of the present invention with reference to the drawings. In the actual apparatus, the bending length of the work is executed up to 30 to 300 cm, but for the convenience of simplicity of the description, in the shown embodiment, the case that the four split dies ($100\times4\times2=800$ mm) and six central reversible dies (5 mm$\times$1, 10 mm$\times$1, 20 mm$\times$4 of 95 mm) are associated to 895 mm at the maximum) will be described. In order to bend the work 895 mm with the dies, as shown in FIG. 2, the split dies 2A, 2B . . . , 2E, 3A, 3B . . . , 3E, and the reversible dies 1A, 1B . . . , 1F are inserted into the groove 25 of the beam 21 provided at the lower end of the ram. The split dies are inserted at the upper ends into the groove 25, and are clamped by the bolt 22. Since the reversible dies are maintained inserted into the groove 25 of the upper end of the beam 21 by the operation of the reversing mechanism, the dies are not clamped by the bolt 22. The main cylinder 12 for bending is actuated in this condition to move down the ram 13 to bend the work sheet 90 at the maximum length utilizing all the upper dies as shown in FIG. 3.

(1) Alteration of 100 mm Pitch

In case of altering the dies at 100 mm pitch, the split upper dies of the ends are moved. In case of the manual operation, the bolt 22 is not loosely removed, but in case of the automatic actuation, the following operation will be carried out. That is, the rod 31A or 31B is rotated to engage the left or right pawl 51 with the recess 53 of the back face of the split die 2B or 3A, and the screw rod 31A, 31B are rotated in the engaged state to separate the split dies approx. 25 to 50 mm from the side face of the adjacent upper die. The die length of 200 mm can be adjusted by rotating the screw rods 31A, 31B while the left and right pawls 51 remain engaged with the recesses of the split dies 2B, 3A.

(2) Adjustment of 100 mm or Shorter

Then, the adjustment of the die length of 100 mm or shorter will be described. In the shown embodiment, the die length is adjusted up to 5 to 95 mm at 5 mm pitch. The entire dies are laterally moved leftward or rightward 12.5 mm from the center 100 of the bending machine or press in ranges of 5 to 25 mm and 55 to 95 mm.

These movements of the dies will be described with reference to FIGS. 17 to 22. FIGS. 17 to 22 schematically show the reversible dies 1A to 1F and the brackets 4, 5 by omitting the reversibly supporting shaft 31 and the screw rods 31A, 31B.

(a) Adjustment of 5 to 15 mm

Figure 17:
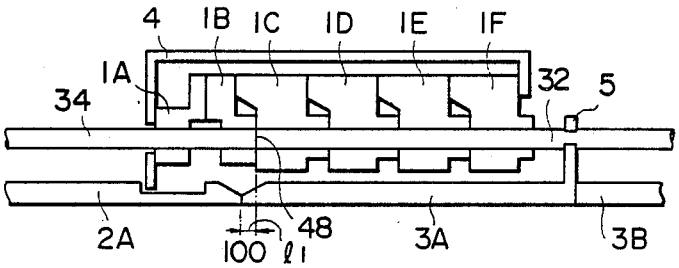
FIGS. 17 to 22 are schematic plan views showing the die length adjusting operation by the reversible dies.

FIG. 17 shows the condition that the brackets 4, 5 are closely contacted similarly to FIG. 4, the boundary 48 of the spline cylinders 32, 34 is disposed at the position moved $l_1=5$ mm from the center 100 of the bending machine or press, and the 5 mm die 1A and the 10 mm die 1B are engaged with the rotatable spline cylinder 34. The following actuation will be executed to adjust the dies 15, 10 and 5 mm.

The 5 mm die 1A and the 10 mm die 1B are set in an unlocked state as shown in FIG. 10. That is, the arm 37 is urged counterclockwise by the tension of the spring 38, the lower portion 37*a* of the arm 37 is engaged with the recess 39 to be integrated with the spline cylinder 34. The left side split die 2A is moved leftward 15 mm in this state to form a gap, the rack bar 47 is then actuated to rotate the spline cylinder 34 approx. 180° to 200°. Thus, the reversible dies 1A and 1B are rotated to be moved to the upper die row as shown by chain lines in FIG. 18. The reversible dies 1A, 1B are added between the split dies 2A and 3A to thus complete the adjustment of the die length of 15 mm.

Figure 18:
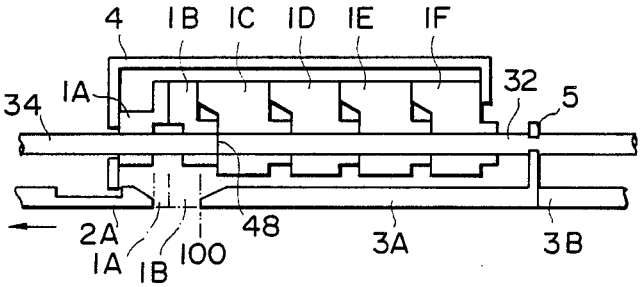

Then, when only the locking cylinder 62 of the reversible die 1A side is actuated to be locked at the bracket 4 side, the reversible die 1B remains unlocked and the spline cylinder 34 is rotated, only the 10 mm length reversible die 1B is moved to the upper die row. In FIG. 18, a gap of 15 mm is formed, and when a gap (5 mm) is closed, the adjustment of 10 mm die length is completed. In case of the adjustment of 5 mm die length, the reversible die 1B is locked, while the reversible die 1A remains unlocked. The 5 mm length reversible die 1A is moved to the upper die row by rotating the dies similarly to the above-described actuation in this state. Since the 5 mm die is inserted into the gap of 15 mm, the split die 2A is moved rightward 10 mm to close the gap, thereby completing the adjustment of the 5 mm die length.

In case of the above-mentioned 5 to 15 mm adjustments, the dies remain at the reversible positions. Since the third to the sixth reversible dies 1C, 1D, 1E, 1F are engaged with the non-rotating first spline cylinder 32, these dies do not actuate, but remain steadily at the reversible position.

(b) Adjustments of 20 to 35 mm

Figure 19:
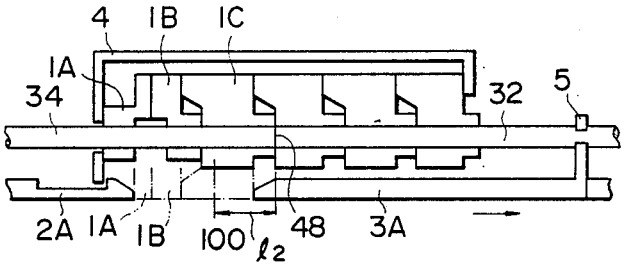

The rods 31A, 31B are moved rightward $l_2=15$ mm from the center 100 of the bending machine or the press to engage the 5 mm die 1A, 10 mm die 1B and 20 mm die 1C with the rotatable spline cylinder 34 as shown in FIG. 19.

In case of 35 mm adjustment, the reversible dies 1A, 1B are unlocked and the spline cylinder 34 is rotated to complete the adjustment of 35 mm as shown by chain lines in FIG. 19. In this case, the reversible die 1B or 1A is locked to the bracket 4, and rotated to form gaps, thereby adjusting the 30 mm or 25 mm die length.

(c) Adjustment of 40 to 95 mm

Figure 20:
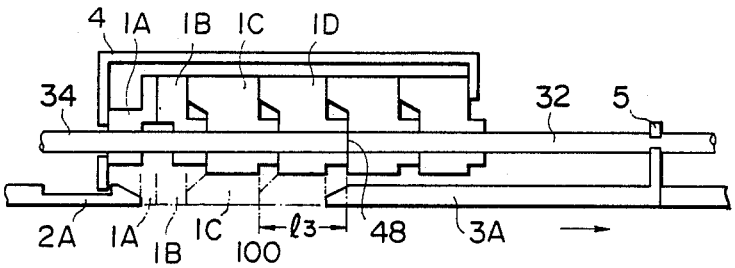
Figure 21:
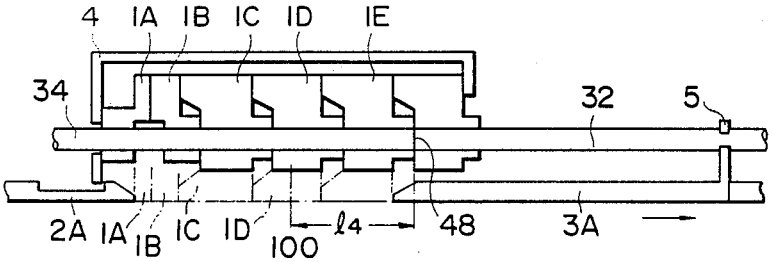
Figure 22:
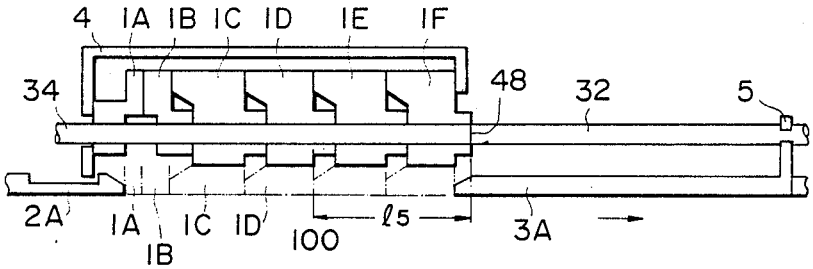

FIG. 20 shows the condition that the boundary 48 is moved rightward $l_3=25$ mm from the center 100 of the bending machine, the reversible dies 1A, 1B and two 20 mm dies 1C, 1D are then associated to adjust 40, 45 and 55 mm. FIG. 21 shows the condition that the boundary 48 is moved similarly $l_4=35$ mm and 3 20 mm dies 1C, 1D, 1E are associated to adjust 60, 65, 70, 75 mm, and FIG. 22 shows the condition that the boundary 48 is moved $l_5=45$ mm, and 4 20 mm dies 1C to 1F are associated to adjust 80, 85, 90 and 95 mm.

As above mentioned, the present invention provides the reversing levers which can removably support the reversible dies to the reversibly supporting shaft laterally installed at the rear side of the ram. Therefore, the dies can be readily exchanged from the die to the gooseneck dies.

What is claimed is:

1. An apparatus for exchanging a tool of a bending machine comprising:

a frame, a ram movably mounted on said frame, a drive unit connected to said frame for moving of the ram in an upward and a downward direction, said ram having a front side and rear side, a reversible supporting shaft unit having an axis and being rotatably mounted on said frame to the rear side of said ram for rotation about said axis, a plurality of dies movably mounted on said frame, said dies mounted in side-by-side relation and located in parallel relationship to said shaft unit, a reversing lever unit secured to said reversible supporting shaft unit, said reversing lever unit projecting outwardly from said shaft unit and having an outer die mounting end portion thereon, said die mounting end portion of said reversing lever unit being coupled to said dies, said reversing lever unit locating said dies relative to said ram when rotating by said shaft unit, and a positioning unit for selectively positioning said reversing lever unit on said reversible supporting shaft unit to thereby enable selective positioning of said dies, upon rotation of said shaft unit, between a coupling position with said ram and an uncoupling position spaced from said ram.

2. The apparatus of claim 1 further comprising:

a left bracket secured to said frame adjacent one side of said reversible dies, a right bracket secured to said frame to the opposite side of said reversible dies, said supporting shaft unit having an axial opening, a first spline cylinder mounted on said reversible supporting shaft unit, and means connected to said right bracket said first spline cylinder for restricting rotation of said first spline cylinder, said first spline cylinder having a cylindrical portion extending from said right bracket, a second spline cylinder rotatably mounted on said cylindrical portion, said reversing lever unit including a plurality of reversing levers mounted over said first and second spline cylinders between the left and right brackets, each of said reversible dies having a hole for receiving said lever unit, each of said levers being inserted into a hole of a different one of said reversible dies, said positioning unit including a number-of-reversing dies selecting means connected to said cylinders and moving the boundary of both said spline cylinders to locate a predetermined number of said reversible dies to be engaged with said second spline cylinder, and reversible driving means coupled to said second spline cylinder for rotating said reversing levers about 180 degrees about the axis of said supporting shaft unit with said levers in engagement with said second spline cylinder.

3. The apparatus as claimed in claim 2, wherein said reversible driving means comprises a rack bar engaged with said second spline cylinder and operable to rotate said second spline cylinder, and a power cylinder connected to said rack bar for reciprocating said rack bar.

4. The apparatus of claim 2, wherein said positioning unit includes a selecting means coupled to the reversing levers and moving the levers into operative engagement with said second spline cylinder for reversing of said levers, said selecting means also moving the reversing levers from said operative engagement with said second spline cylinder so as to prevent reversing of said levers, said selecting means further having locking means secured to said frame and to said levers and operable to hold the levers disengaged from said second spline cylinder and against movement.

5. An apparatus for exchanging a tool of a bending machine comprising:

a frame, a ram movably mounted to said frame for movement in a vertical direction, said ram having a front side and a rear side, a plurality of reversible dies releasably connected in side-by-side alignment to the lower end of said ram, said plurality of reversible dies having a first end and a second end, first split dies located to the first end of said reversible dies and slidably mounted on the lower end of said ram and second split dies located to the second end of the reversible dies, said split dies being slidably mounted on the lower end of said ram, a reversible supporting shaft unit located at the rear side of said ram and spaced laterally from said ram and said reversible dies, said shaft unit having an axis and being mounted for rotation about said axis, a reversing lever unit mounted on said reversible supporting shaft unit, said reversing lever unit and extending from said supporting shaft to an outer end, said outer end being releasably coupled to said reversible dies, said reversing lever unit individually positioning said reversible dies when rotated by said shaft unit, and a positioning unit selectively positioning the reversing lever unit on said shaft unit to thereby enable said reversible dies, upon rotation of the shaft unit to couple and decouple with respect to said ram.

6. The apparatus as claimed in claim 5 including:

a sliding support on said ram for said split dies, said sliding support extending parallel to said shaft unit, first and second brackets mounted to the rear side of the ram and aligned with said reversing lever unit, said reversible supporting shaft unit including a first spline cylinder, means connecting said first spline cylinder to the first bracket, said first spline cylinder having an extended cylindrical portion connected to said second bracket, a second spline cylinder rotatably mounted on said cylindrical portion and located in abutting alignment with said first spline cylinder and defining a boundary at the abutment between said cylinders, each of said reversible dies having a hole for receiving the reversing lever unit, said reversing lever unit including a plurality of levers with of lever aligned with one said reversible dies, said levers being mounted for sliding movement over said first and second spline cylinders between the left and right brackets and positioned to opposite sides of said boundary, each of said levers projecting into the hole of the aligned reversible die, said positioning unit including a number-of-reversing dies selecting means for moving said cylinders on said shaft unit and thereby said boundary of said spline cylinders relative to said lever unit to thereby position a predetermined number of said reversible dies in engagement with said second spline cylinder, and a reversible driving unit for rotating said shaft unit and thereby said reversing levers mounted on said second cylinder about 180 degrees.

7. The apparatus of claim 6, wherein said selecting means moves the die and reversing levers into operative engagement with said second spline cylinder for reversing of said levers and moves the reversing levers from said operative engagement with said second spline cylinder for preventing reversing of said levers, and having locking means secured to said frame and to said levers and operable to hold the levers operatively disengaged from said second spline cylinder against movement.

8. The apparatus as claimed in claim 7, wherein each of said reversing levers includes a shoulder engaging one end of the hole in said reversible dies, and said lever having a hook on the outer end thereof, said hook engaging the die adjacent the hole of the corresponding reversible die.

9. The apparatus of claim 6, wherein said number-of-reversing dies selecting means comprises a rod engaged with the left and right split dies, said left and right split dies being disposed at the center between said reversible dies, and actuators coupled to at the ends of said rod for moving said rods and thereby said split dies.

10. The apparatus as claimed in claim 6, including first and second screw rods threaded into opposite ends of said first spline cylinder and first and second pawl members threaded on said screw rods, one of said rods ;having clockwise threads and the other of said rods having counterclockwise threads, whereby rotation of said rods moves said pawls, said first spline cylinder having a cylindrical portion located between said pawls and engaged at the threaded portions, said split dies having recesses on back faces thereof and said pawls having members engaging said recesses to move said split dies in a direction parallel to said shaft unit.

11. The apparatus as claimed in claim 6, wherein said reversible driving unit comprises a rack bar engaged with said second spline cylinder, and a power cylinder is connected to said rack bar for reciprocating said rack bar.

* * * * *

UNITED STATES PATENT AND TRADEMARK OFFICE

CERTIFICATE OF CORRECTION

PATENT NO. : 4,930,332

DATED : June 5, 1990

INVENTOR(S) : Toshio Hongo

It is certified that error appears in the above-identified patent and that said Letters Patent is hereby corrected as shown below:

IN THE TITLE:

After "tool" delete "for" and substitute therefor ---of---

IN THE CLAIMS:

In Column 11, line 57 CLAIM 5 — Delete "releasably coupled" and substitute therefor ---releasable coupling---

In column 12, line 56, claim 10, Delete ";" before "having"

Signed and Sealed this

Thirteenth Day of August, 1991

*Attest:*

*Attesting Officer*

HARRY F. MANBECK, JR.

*Commissioner of Patents and Trademarks*